US010939749B2

(12) United States Patent
Fitzpatrick

(10) Patent No.: US 10,939,749 B2
(45) Date of Patent: Mar. 9, 2021

(54) MODULAR FOLDING TABLE WITH COLLAPSIBLE LEGS

(71) Applicant: Diewood LLC, San Francisco, CA (US)

(72) Inventor: Joseph James Fitzpatrick, San Francisco, CA (US)

(73) Assignee: Diewood LLC, San Francisco, CA (US)

( * ) Notice: Subject to any disclaimer, the term of this patent is extended or adjusted under 35 U.S.C. 154(b) by 0 days.

(21) Appl. No.: 16/791,131

(22) Filed: Feb. 14, 2020

(65) Prior Publication Data

US 2020/0268143 A1 Aug. 27, 2020

Related U.S. Application Data

(60) Provisional application No. 62/810,547, filed on Feb. 26, 2019.

(51) Int. Cl.

| | |
|---|---|
| ***A47B 3/02*** | (2006.01) |
| ***A47B 3/06*** | (2006.01) |
| ***A47B 9/00*** | (2006.01) |

(52) U.S. Cl.

CPC ..... *A47B 3/02* (2013.01); *A47B 3/06* (2013.01); *A47B 9/00* (2013.01); *A47B 2003/025* (2013.01)

(58) Field of Classification Search

CPC ..... A47B 3/02; A47B 3/06; A47B 3/10

USPC ... 108/116, 118, 33, 124, 157.17, 34, 38, 67

See application file for complete search history.

(56) References Cited

U.S. PATENT DOCUMENTS

| | | | | | |
|---|---|---|---|---|---|
| 33,529 | A * | 10/1861 | Lane | A47B 3/10 | 190/12 R |
| 1,154,692 | A * | 9/1915 | Dehullu | A47B 3/04 | 108/34 |
| 1,446,917 | A * | 2/1923 | McGrew | A47B 3/02 | 108/36 |
| 1,483,736 | A * | 2/1924 | Larsen | A47B 3/02 | 190/12 R |

(Continued)

FOREIGN PATENT DOCUMENTS

| | | | | |
|---|---|---|---|---|
| WO | WO-2019024864 A1 * | 2/2019 | ..... | A47B 3/02 |

OTHER PUBLICATIONS

"LiteDie Travel Table," at Welcome to LiteDie: The Only Way to Play Die at Night <https://litedie.com> retrieved on Feb. 21, 2020.

*Primary Examiner* — Jose V Chen

(74) *Attorney, Agent, or Firm* — Cognition IP, P.C.; Edward Steakley

(57) ABSTRACT

A portable modular folding table can include a substantially flat tabletop having three or more tabletop sections, hinges coupled to the tabletop sections, and collapsible legs that are modular and separate from the tabletop. The tabletop can have a width and a length that is at least twice as large as the width, and the tabletop sections are coupled to and foldable onto each other to reduce the length of the tabletop by less than half when the tabletop is reduced from a fully extended configuration to a fully compacted configuration. Each of the collapsible legs can be adjustable to multiple different heights and can have multiple tabletop support points. The tabletop can rest atop the tabletop support points when the tabletop is in a fully extended configuration and the tabletop can be separated from and stored alongside the collapsible legs when the tabletop is in a fully compacted configuration.

20 Claims, 15 Drawing Sheets

(56) References Cited

U.S. PATENT DOCUMENTS 2,588,405 A * 3/1952 Munger ..... A47B 3/12 108/34
2,903,313 A * 9/1959 Block ..... A47B 3/083 108/35
3,079,875 A * 3/1963 Hasler ..... A47B 13/08 108/38
4,565,403 A * 1/1986 Brown ..... A47C 11/00 297/3
4,686,910 A * 8/1987 Skjerseth ..... A47B 3/02 108/118
4,974,525 A * 12/1990 Sheffield ..... A47B 3/02 108/118
5,358,204 A * 10/1994 Terada ..... F16M 11/38 108/118
5,816,545 A * 10/1998 Malizia ..... A47B 3/02 248/164
5,829,365 A * 11/1998 Cheng ..... A47B 3/02 108/118
6,536,359 B2 * 3/2003 Liu ..... A47B 3/02 108/118
6,840,182 B2 * 1/2005 Price ..... A47B 77/02 108/101
6,974,185 B2 * 12/2005 Hsieh ..... A47C 3/36 108/117
7,370,908 B2 * 5/2008 Crowell ..... A47C 4/02 108/118
10,258,143 B1 * 4/2019 Kenyon ..... A47B 3/083
2003/0164121 A1 * 9/2003 Winter ..... A47B 9/16 108/118
2005/0155530 A1 * 7/2005 Goldberg ..... A47B 31/04 108/118
2005/0199162 A1 * 9/2005 Hendricks ..... A47B 3/02 108/118
2012/0204770 A1 * 8/2012 Grace ..... A47B 9/20 108/116
2015/0084383 A1 * 3/2015 Zhu ..... A47B 3/06 297/139
2018/0255918 A1 * 9/2018 Walker ..... A47B 3/0818

* cited by examiner

MODULAR FOLDING TABLE WITH COLLAPSIBLE LEGS

CROSS-REFERENCE TO RELATED APPLICATION

This application claims the benefit of U.S. Provisional Patent Application No. 62/810,547 filed on Feb. 26, 2019 and entitled "FOLDING WOOD TABLE WITH BENT TENT ROD LEGS," which application is hereby incorporated by reference in its entirety.

BACKGROUND

Portable tables such as card tables, camping tables, picnic tables, display tables, and the like may often be folded and compacted for storage or transportability. Many types of portable tables include folding legs that hinge or connect to the underside of the table and pivot inward along table edges to reduce the table to a substantially flat configuration defined by the tabletop. Other common portable table designs combine a folding tabletop with folding legs, such as ping pong tables and other gaming tables. Unfortunately, many of these table designs result in a compacted table that may be flattened but still has the same width and length of the fully expanded table. While many folding tabletop designs can result in a compacted table with half the length of the fully expanded table, this may still be undesirably long for some table arrangements. Furthermore, many portable tables include folding legs that only allow for one height of the fully expanded table. Added weight is also a concern as table complexity increases.

Although traditional portable tables have worked well in the past, improvements are always helpful. In particular, what is desired are lightweight portable folding tables that compact to a flat configuration that is less than half the length of the fully expanded table and that can be set at many different heights when fully expanded.

SUMMARY

It is an advantage of the present disclosure to provide tables that are portable and lightweight, that compact to a flat configuration, and that can be set at many different heights when fully expanded. The disclosed features, apparatuses, systems, and methods provide improved portable folding tables that compact into a self-contained package that is easily carried and stored in small storage compartments, such as those found in recreational vehicles, airplanes, or small living areas. These advantages can be accomplished at least in part by including a tabletop that folds into a compacted configuration and modular collapsible legs that are separate from the tabletop and that can be set at many different heights.

In various embodiments of the present disclosure, a portable modular folding table can include a substantially flat tabletop, a plurality of hinges, and a plurality of collapsible legs. The tabletop can have a width and a length that is at least twice as large as the width and can include three or more tabletop sections having the same width that are coupled to and foldable onto each other. The hinges can be coupled to the three or more tabletop sections and can facilitate the folding and unfolding of the three or more tabletop sections onto each other. The collapsible legs can be modular and separate from the tabletop, and each of the collapsible legs can be adjustable to multiple different heights.

In various detailed embodiments, the tabletop sections can be foldable onto each other to reduce the length of the tabletop by less than half when the tabletop is reduced from a fully extended configuration to a fully compacted configuration. A first tabletop section can have a first length, a second tabletop section can have a second length that is greater than the first length, and a third tabletop section can have a third length that is greater than the second length. A first hinge can couple a first tabletop section to a second tabletop section along the first and second tabletop section widths, can extend along at least 80 percent of the first and second tabletop section widths, and can pivot the first tabletop section from a first position alongside and abutting the second tabletop section to a second position directly atop and contacting the second tabletop section. A second hinge can couple a third tabletop section to the second tabletop section along the third and second tabletop section widths, and can pivot the third tabletop section from a third position alongside and abutting the second tabletop section to a fourth position directly atop and contacting the first tabletop section when the first tabletop section is in the second position. The second hinge can pivot the third tabletop section such that there is a gap between the second tabletop section and third tabletop section when the third tabletop section is substantially parallel with the second tabletop section. The gap thickness can be substantially the same as the thickness of the first tabletop section.

In various further detailed embodiments, each of the collapsible legs can include at least four tabletop support points, and the tabletop can rest atop at least some of the tabletop support points when the tabletop is in a fully extended configuration. Each of the collapsible legs can also include a rotational coupling, two elongated leg members arranged in an X configuration and rotationally coupled at about the center points of their respective lengths by the rotational coupling, and a cross-member at each distal end of each elongated leg member, with each cross-member extending away laterally from its respective elongated leg member. Each of the collapsible legs can be adjustable to multiple different heights by adjusting the rotational coupling. The tabletop support points can be located at the distal ends of the cross-members, and at least one of the collapsible legs can be configured to provide the tabletop support points of one cross-member proximate one of the hinges when the tabletop rests atop the tabletop support points. That collapsible leg can also be configured to provide the tabletop support points at another cross-member at an end section of the tabletop when the tabletop rests atop the tabletop support points. Also, the tabletop can be separate from and stored alongside the collapsible legs when the tabletop is in a fully compacted configuration. In various alternative detailed embodiments, each collapsible leg can be a bendable tent-pole style of leg.

In still further detailed embodiments, the length of the tabletop can be about eight feet when the tabletop is in a fully extended configuration. The width of the each of the three or more tabletop sections can be about two feet in some embodiments or can be about four feet in other embodiments. Also, the tabletop and collapsible legs can all be configured to be stored within the same storage device when the tabletop is in a fully compacted configuration and all of the plurality of collapsible legs are collapsed, and the storage device can have a length, width, and thickness that are all less than about three feet. In the embodiments where the width of the tabletop sections is about four feet, then the storage device can have a width of about four feet.

Other apparatuses, methods, features, and advantages of the disclosure will be or will become apparent to one with skill in the art upon examination of the following figures and detailed description. It is intended that all such additional apparatuses, methods, features and advantages be included within this description, be within the scope of the disclosure, and be protected by the accompanying claims.

BRIEF DESCRIPTION OF THE DRAWINGS

The included drawings are for illustrative purposes and serve only to provide examples of possible structures and arrangements for the disclosed apparatuses, systems and methods for portable folding tables. These drawings in no way limit any changes in form and detail that may be made to the disclosure by one skilled in the art without departing from the spirit and scope of the disclosure.

DETAILED DESCRIPTION

Figure 1A:
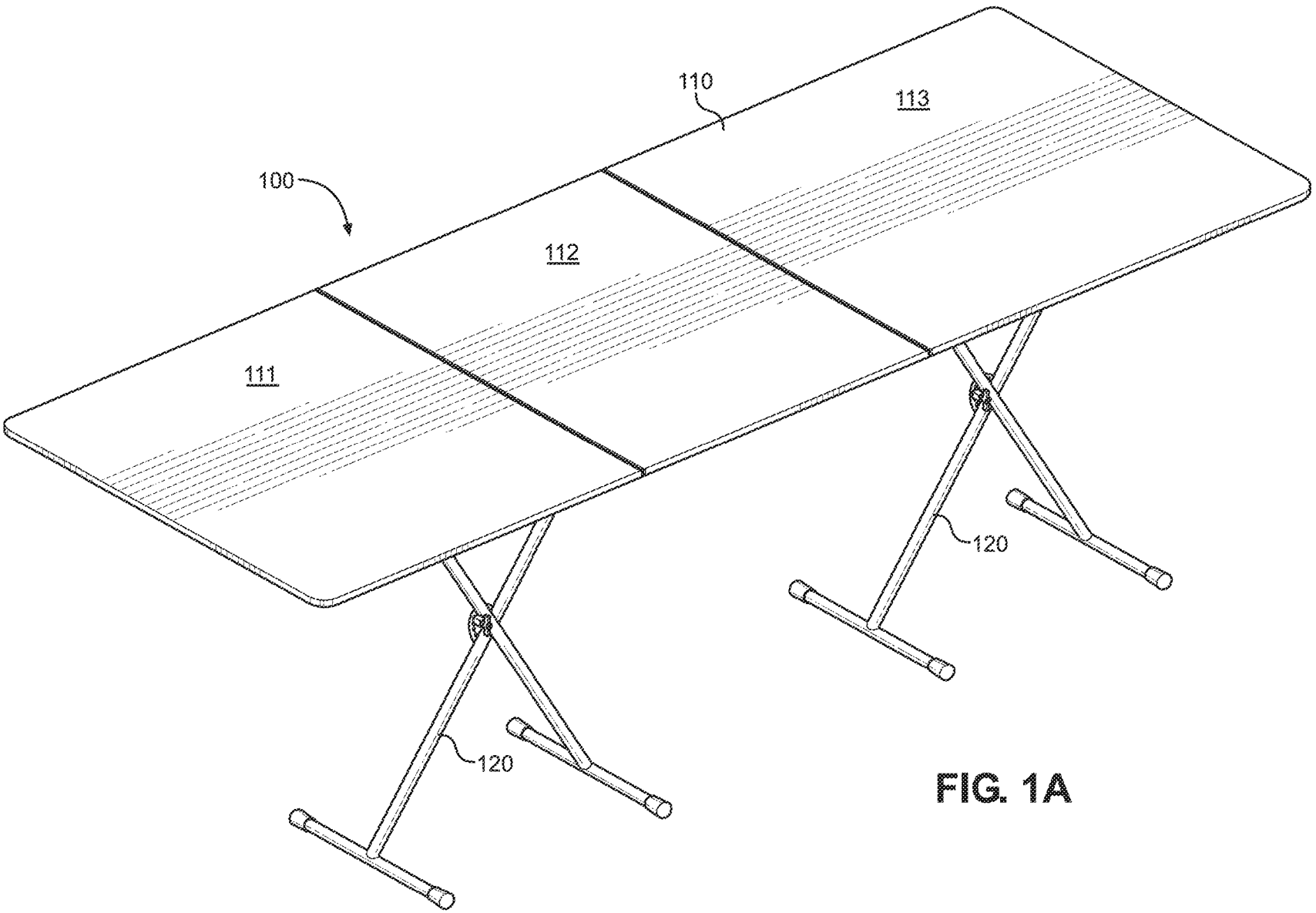
FIG. 1A illustrates in top perspective view an example modular folding table with collapsible legs according to one embodiment of the present disclosure.

Exemplary applications of apparatuses, systems, and methods according to the present disclosure are described in this section. These examples are being provided solely to add context and aid in the understanding of the disclosure. It will thus be apparent to one skilled in the art that the present disclosure may be practiced without some or all of these specific details provided herein. In some instances, well known process steps have not been described in detail in order to avoid unnecessarily obscuring the present disclosure. Other applications are possible, such that the following examples should not be taken as limiting. In the following detailed description, references are made to the accompanying drawings, which form a part of the description and in which are shown, by way of illustration, specific embodiments of the present disclosure. Although these embodiments are described in sufficient detail to enable one skilled in the art to practice the disclosure, it is understood that these examples are not limiting, such that other embodiments may be used, and changes may be made without departing from the spirit and scope of the disclosure.

The present disclosure relates in various embodiments to features, apparatuses, systems, and methods for folding tables with collapsible legs and associated items. The disclosed embodiments can include a tabletop that folds at multiple locations and collapsible legs that are modular, separate from the tabletop, and can be set at many different heights. Both the tabletop and collapsible legs can be reduced into a compacted configuration that fits within a storage device, such as a bag or backpack, that is easily carried and stored in small storage compartments, such as those found in recreational vehicles, airplanes, closets, or other small spaces within small living areas. The collapsible legs can be X-shape keyboard stand type legs, tent pole type legs, or any other suitable lightweight collapsible type of legs.

The disclosed folding tables can be used for a wide variety of applications, including work, study, meals, card games, and other types of table-based games. One possible use for the disclosed folding tables involves a table game called "Beer Die" or a related table game called "Snappa" These games are often played on a 4×8 foot sheet of plywood that can be cumbersome or difficult to transport and store as a portable unit. Further details and rules regarding Beer Die can be found online at, for example, www.dyeislife.com, among other locations. Although various specific embodiments disclosed herein discuss tables that are eight feet long, such as for use as a Beer Die table, it will be readily appreciated that the disclosed features, apparatuses, systems, and methods can similarly be used for any relevant folding table of any size. For example, the disclosed folding tables can also be used for other table games such as poker and shuffleboard. Other applications, arrangements, and extrapolations beyond the illustrated embodiments are also contemplated.

Referring first to FIG. 1A, an example modular folding table with collapsible legs is illustrated in top perspective view. Portable modular folding table 100 can include at least a tabletop 110 and multiple collapsible legs 120. Tabletop 110 can have a length of about 8 feet, a width of about 2 feet, a thickness of about 0.5 inches, and can be formed from wood, metal, plastic, or any other suitable sturdy tabletop material. Alternative dimensions are also possible, such as those described for table 200 below. Tabletop 110 can include three or more coupled sections, such as first section 111, second section 112, and third section 113. When tabletop 110 is in a fully extended configuration as shown, first section 111, second section 112, and third section 113 can be positioned flush against each other and can combine to form a substantially continuous and unbroken flat upper surface. A centerline can be painted atop the upper surface of tabletop 110, such as at the middle of second section 112. Other features can also be painted on tabletop 110, such as a logo, lettering, or marks for glasses or other game related items.

Figure 1B:
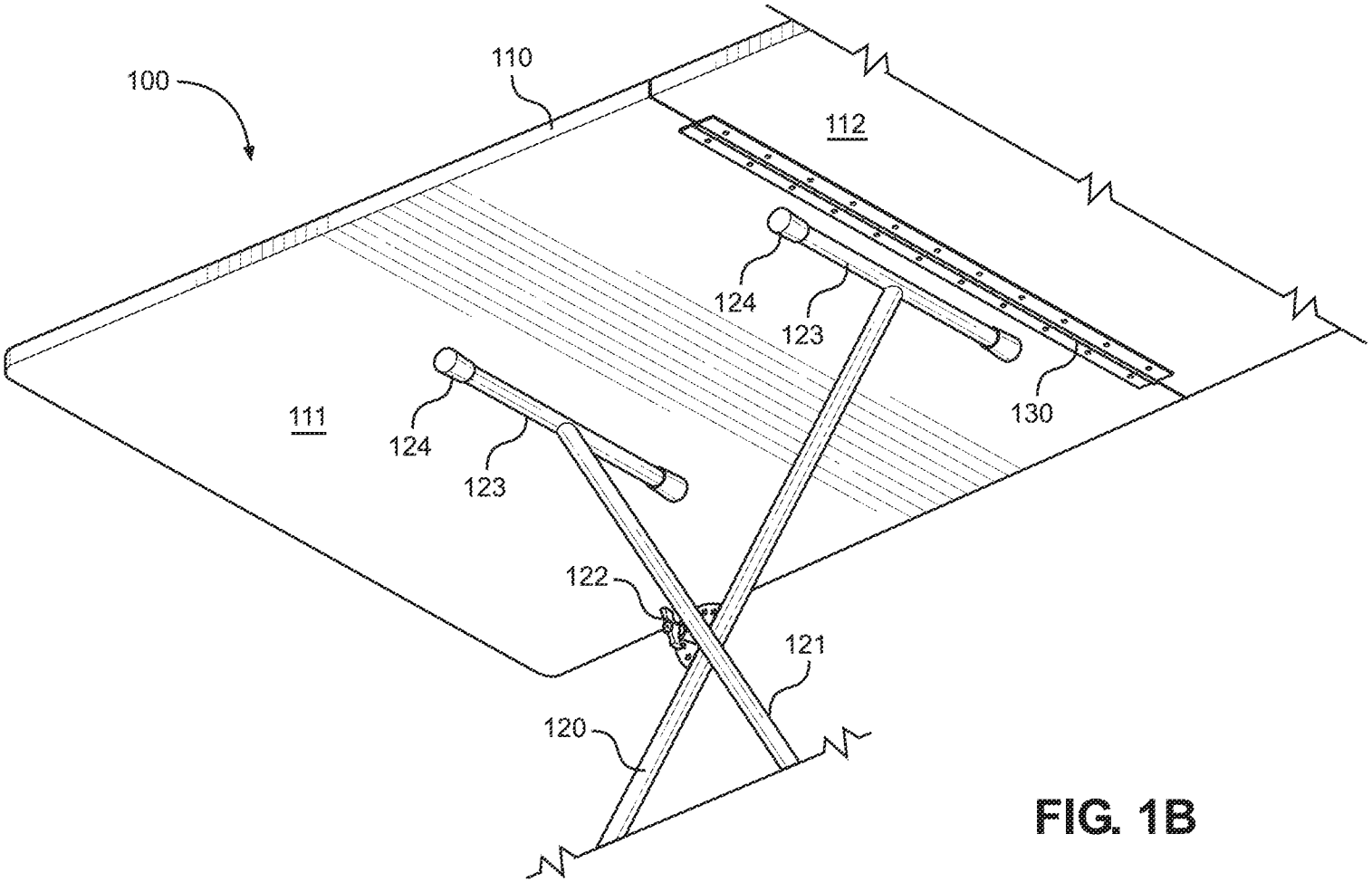
FIGS. 1B and 1C illustrate in bottom perspective views portions of the example modular folding table of FIG. 1A with collapsible legs according to one embodiment of the present disclosure.
Figure 1C:
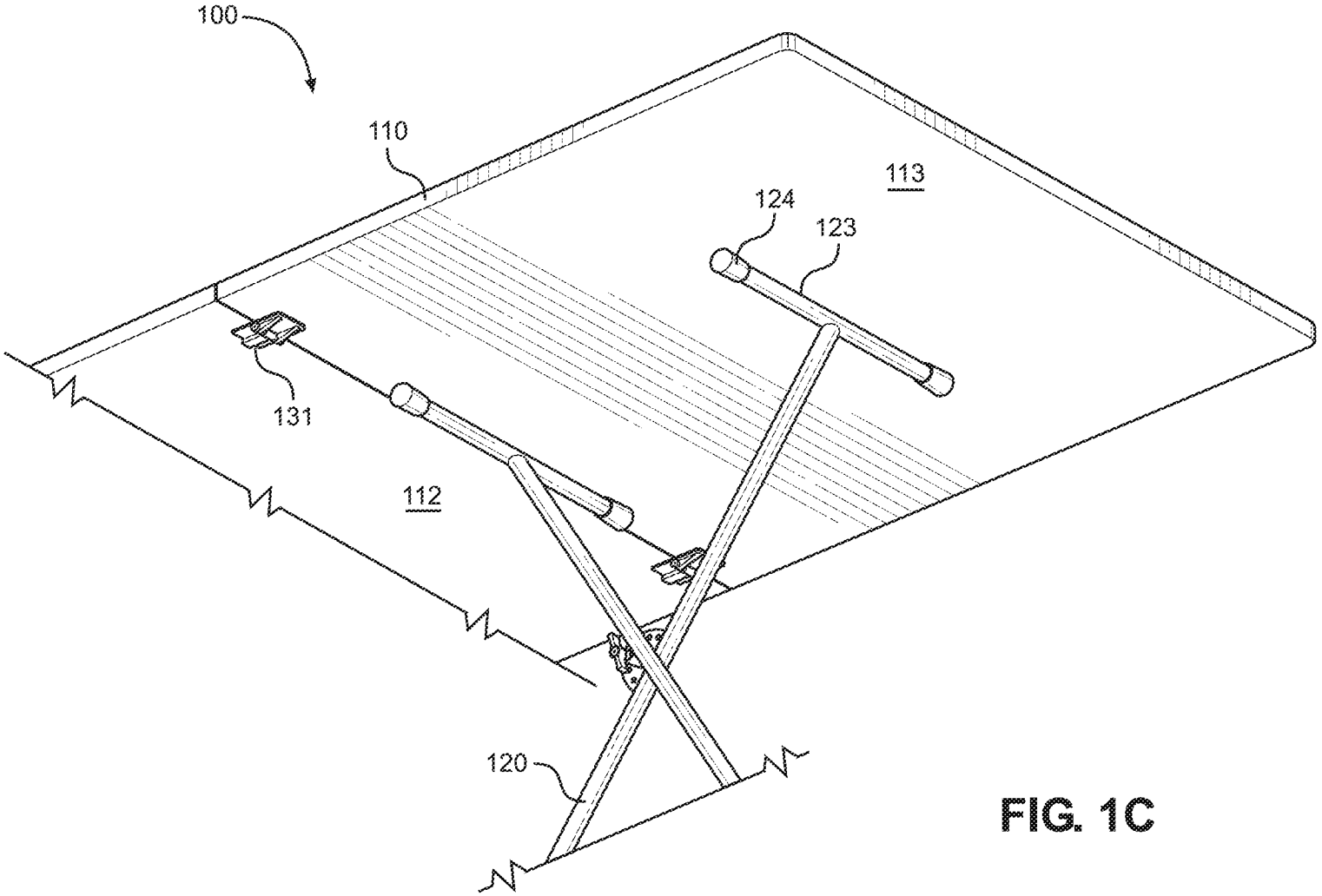

FIGS. 1B and 1C illustrate portions of the example modular folding table of FIG. 1A in bottom perspective views. Tabletop 110 can be placed directly atop collapsible legs 120 such that first section 111 and third section 113 are each directly supported by one collapsible leg 120. Each collapsible leg 120 can include elongated leg members 121, a rotational coupling 122, cross members 123, and tabletop support points 124. As shown, tabletop 110 can be positioned such that some of the tabletop support points 124 contact the bottom surface of tabletop 110 proximate where the ends of different tabletop sections meet. Further details regarding collapsible legs 120 are provided below.

A first hinge 130 can rotationally couple first tabletop section 111 to second tabletop section 112 at their bottom surfaces such that first section 111 can pivot toward second section 112. First hinge 130 can be a piano type hinge and can traverse most of the width of sections 111 and 112 where these sections meet. In some arrangements, first hinge 130 can traverse about 80 percent of the width of sections 111 and 112. At least one second hinge 131 can rotationally couple second tabletop section 112 to third tabletop section 113 at their bottom surfaces such that third section 113 can pivot toward second section 112. Second hinge 131 can be shorter than first hinge 130, and second hinge 131 can be a butt type hinge, flush type hinge, or other similar type of hinge dimensioned to create a constant gap between third section 113 and second section 112 when third section 113 is fully rotated to be substantially parallel with second section 112. This constant gap between second section 112 and third section can have a thickness that matches the thickness of first section 111, such that first section 111 can fit snugly between second section 112 and third section 113 when both of first section 111 and third section 113 are fully rotated with respect to second section 112 so that both are substantially parallel with second section 112.

Figure 2:
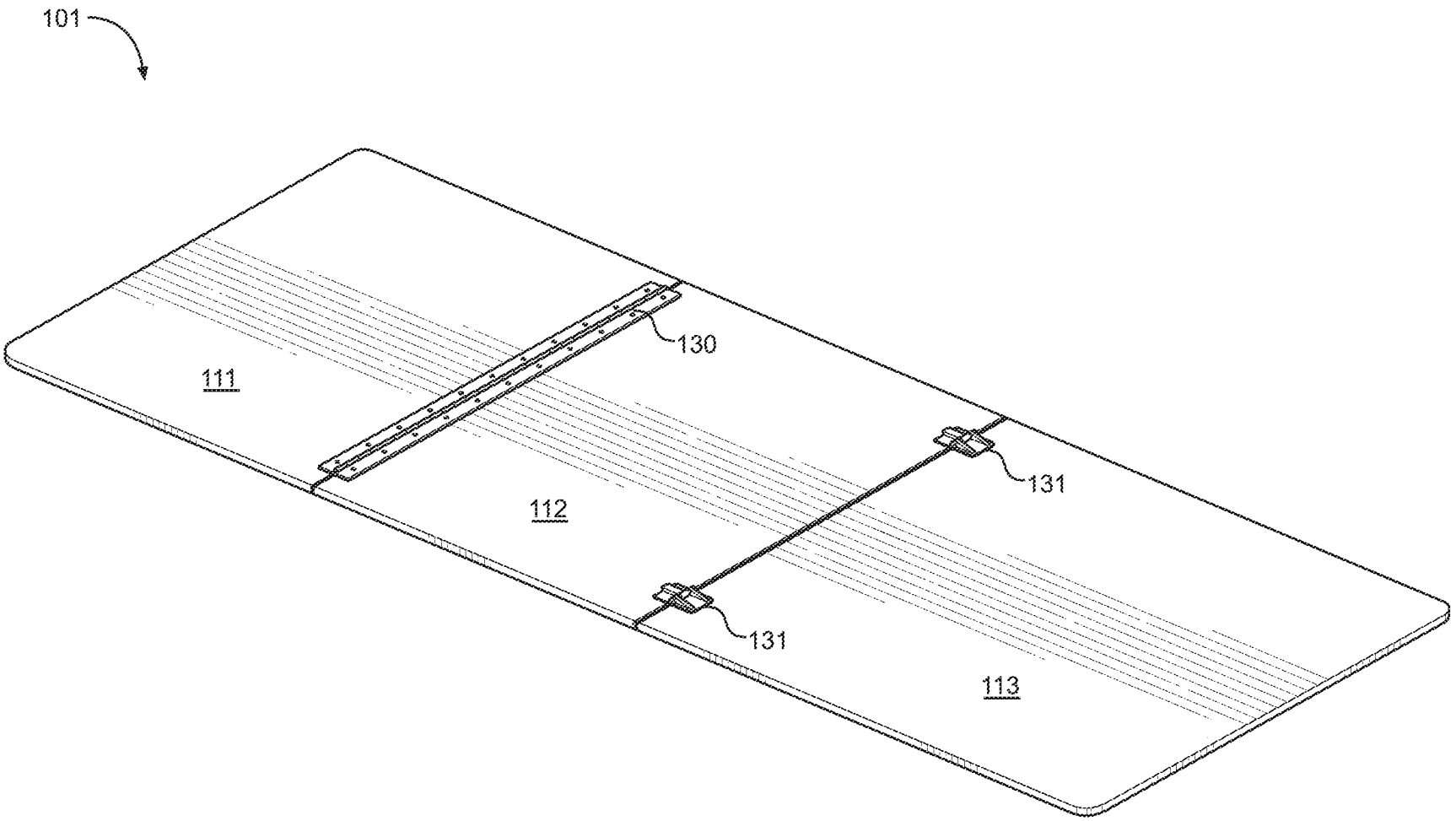
FIG. 2 illustrates in bottom perspective view the example modular folding table of FIG. 1A with its tabletop removed from its collapsible legs according to one embodiment of the present disclosure.

Continuing with FIG. 2, the example modular folding table of FIG. 1A is shown in bottom perspective view with its tabletop removed from its collapsible legs. As shown in configuration 101, tabletop 110 has been lifted off both of collapsible legs 120 and flipped 180 degrees such that its bottom surface is facing up. In various embodiments, tabletop 110 is fully modular with respect to all collapsible legs 120, and no hooks, couplings, or other fasteners are needed to couple tabletop 110 to the collapsible legs 120. In a specific non-limiting embodiment, first section 111 can have a length of about 30.5 inches, second section 112 can have a length of about 32 inches, and third section 113 can have a length of about 33.5 inches. When removed from the collapsible legs 120 and flipped over as shown, tabletop 110 is in a ready position to be folded into a fully compacted configuration.

Figure 3A:
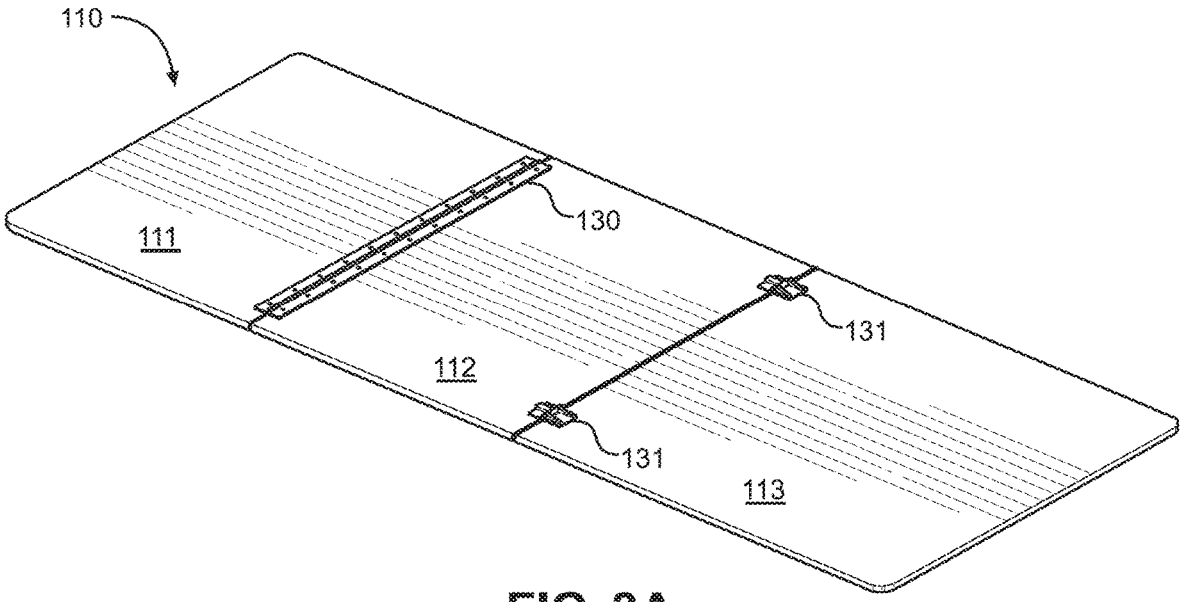
FIG. 3A illustrates in bottom plan view an example folding tabletop having three sections in a fully expanded configuration according to one embodiment of the present disclosure.

Moving to FIGS. 3A-3F, an illustrative process for compacting an example tabletop will now be provided. FIG. 3A illustrates in bottom plan view an example folding tabletop having three sections in a fully expanded configuration. Tabletop 110 can again include multiple tabletop sections 111, 112, and 113 that are rotationally coupled by hinges 130 and 131. While a single lengthy piano type hinge 130 can be used to couple first section 111 to second section 112, multiple shorter butt or flush type hinges 131 can be used to couple third section 113 to second section 112. For example, two butt type hinges 131 can be used at the same or similar distances from the section sides, so as to provide added stability to the tabletop where the second and third sections meet.

Figure 3B:
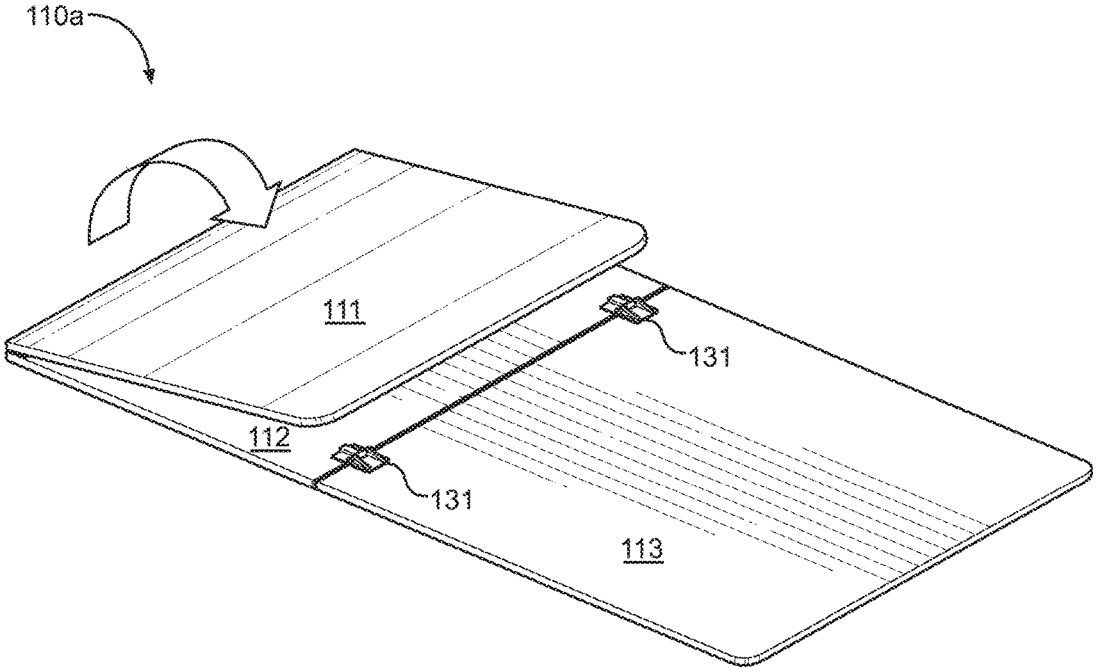
FIG. 3B illustrates in bottom plan view the example folding tabletop of FIG. 3A in a partially folded configuration according to one embodiment of the present disclosure.
Figure 3C:
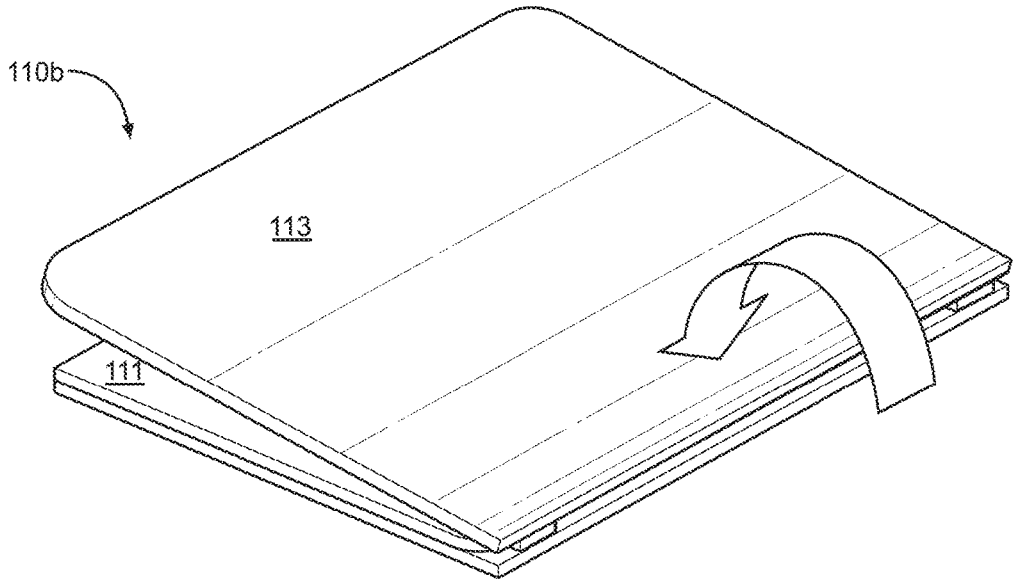
FIG. 3C illustrates in bottom plan view the example folding tabletop of FIG. 3B in a fully compacted configuration according to one embodiment of the present disclosure.

In FIG. 3B, the example folding tabletop of FIG. 3A is shown in bottom plan view in a partially folded configuration 110*a*. Here, tabletop section 111 has been fully rotated about piano type hinge 130 to be substantially parallel with, contact, and rest atop tabletop section 112. In FIG. 3C, the example folding tabletop of FIG. 3B is shown in bottom plan view in a fully compacted configuration 110*b*. Here, tabletop section 113 has been fully rotated about butt type hinges 131 to be substantially parallel with tabletop sections 111 and 112, and to contact and rest atop tabletop section 111. The three tabletop sections 111, 112, and 113 have thus been folded onto each other into a fully compacted configuration that reduced the length of the tabletop 110 to be less than half of its fully extended configuration. In some arrangements, this can reduce the length of tabletop 110 to be about one-third of its full length.

Figure 3D:
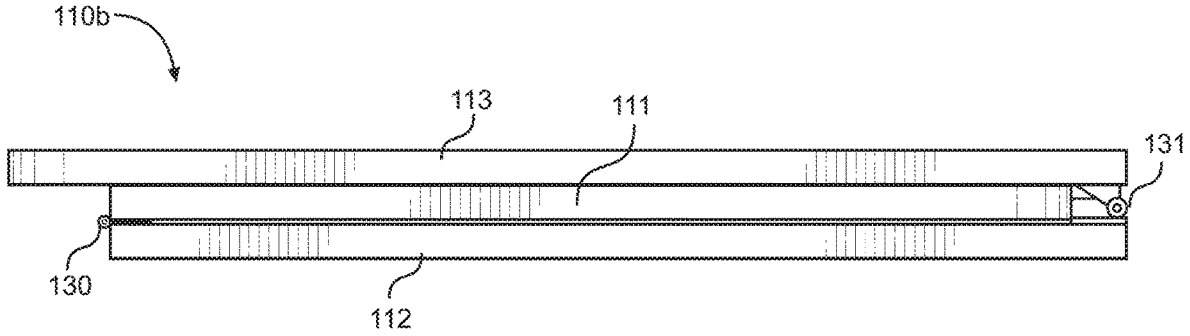
FIG. 3D illustrates in side elevation view the example fully compacted folding tabletop of FIG. 3C according to one embodiment of the present disclosure.
Figure 3E:
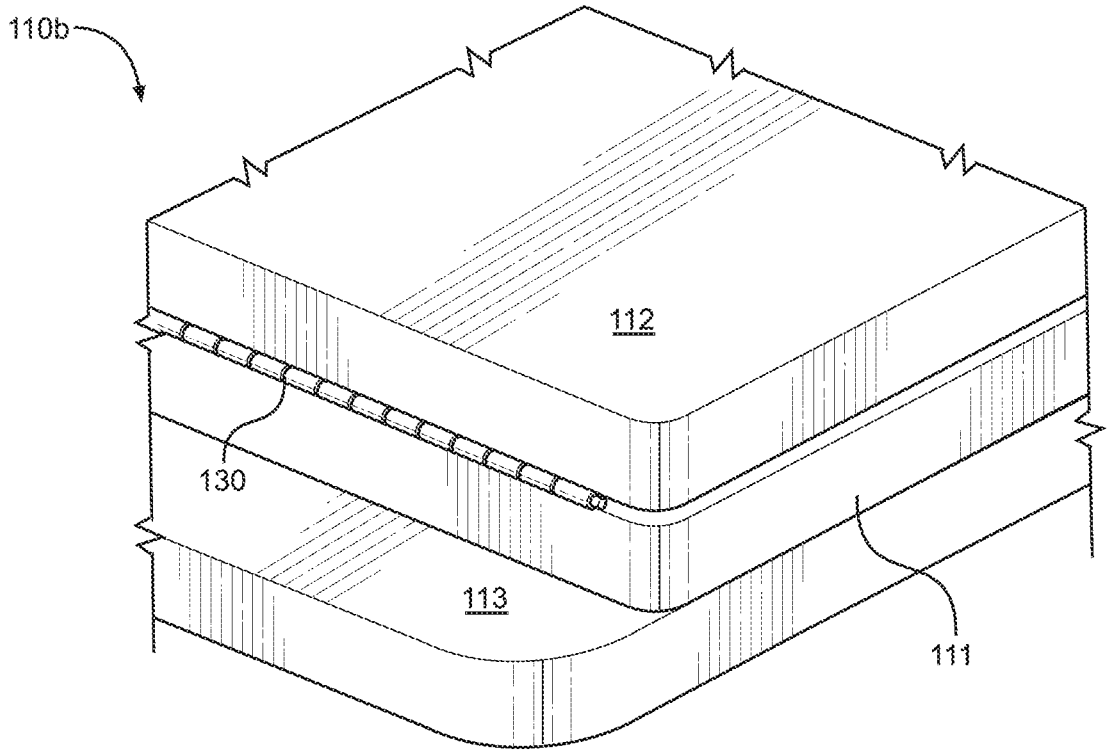
FIG. 3E illustrates in end perspective view a first hinge of the example fully compacted folding tabletop of FIG. 3C according to one embodiment of the present disclosure.
Figure 3F:
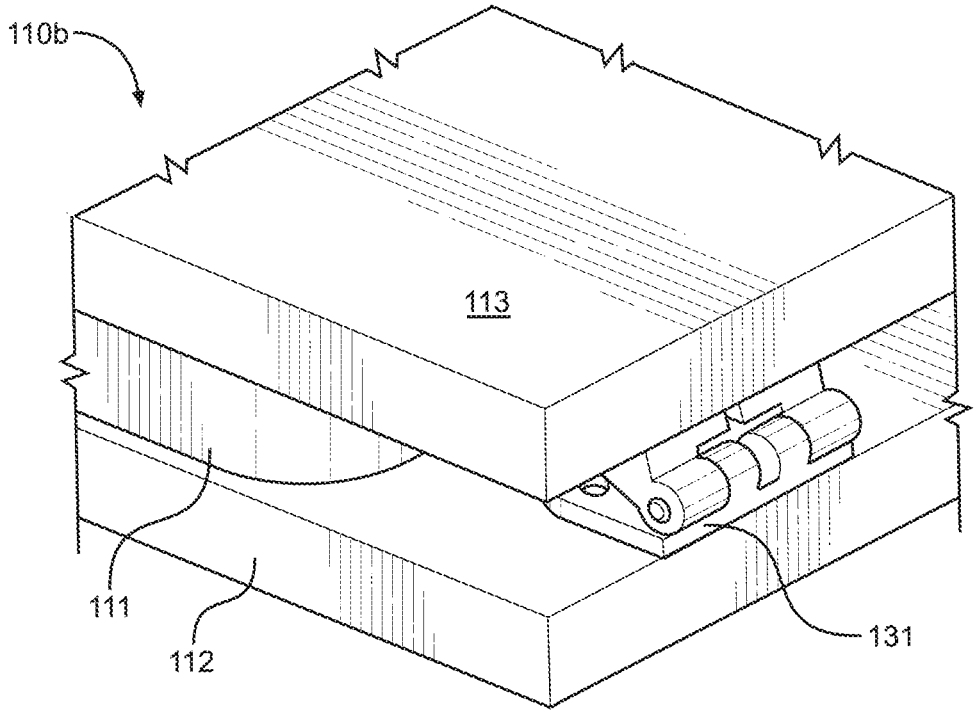
FIG. 3F illustrates in end perspective view a second hinge of the example fully compacted folding tabletop of FIG. 3C according to one embodiment of the present disclosure.

FIG. 3D illustrates in side elevation view the example fully compacted folding tabletop of FIG. 3C. In fully compacted figuration 110*b*, it can be seen that all three sections 111, 112, and 113 are substantially parallel to each other and that section 111 fits snugly between sections 112 and 113. Piano type hinge 130 is located at one end of fully compacted tabletop configuration 110*b*, while the butt type hinges 131 are located at an opposite end of the configuration. FIG. 3E illustrates in end perspective view a first hinge, while FIG. 3F illustrates in the opposite end perspective view a second hinge of the example fully compacted folding tabletop of FIG. 3C. First hinge 130, which again can be a single piano type hinge, couples together sections 111 and 112 such that section 111 folds tightly atop section 112. Second hinge 131, which again can be multiple butt type hinges, couples together sections 112 and 113 and is dimensioned to provide a properly spaced gap to contain section 111 in the middle of the fully compacted tabletop configuration 110*b*.

Figure 4A:
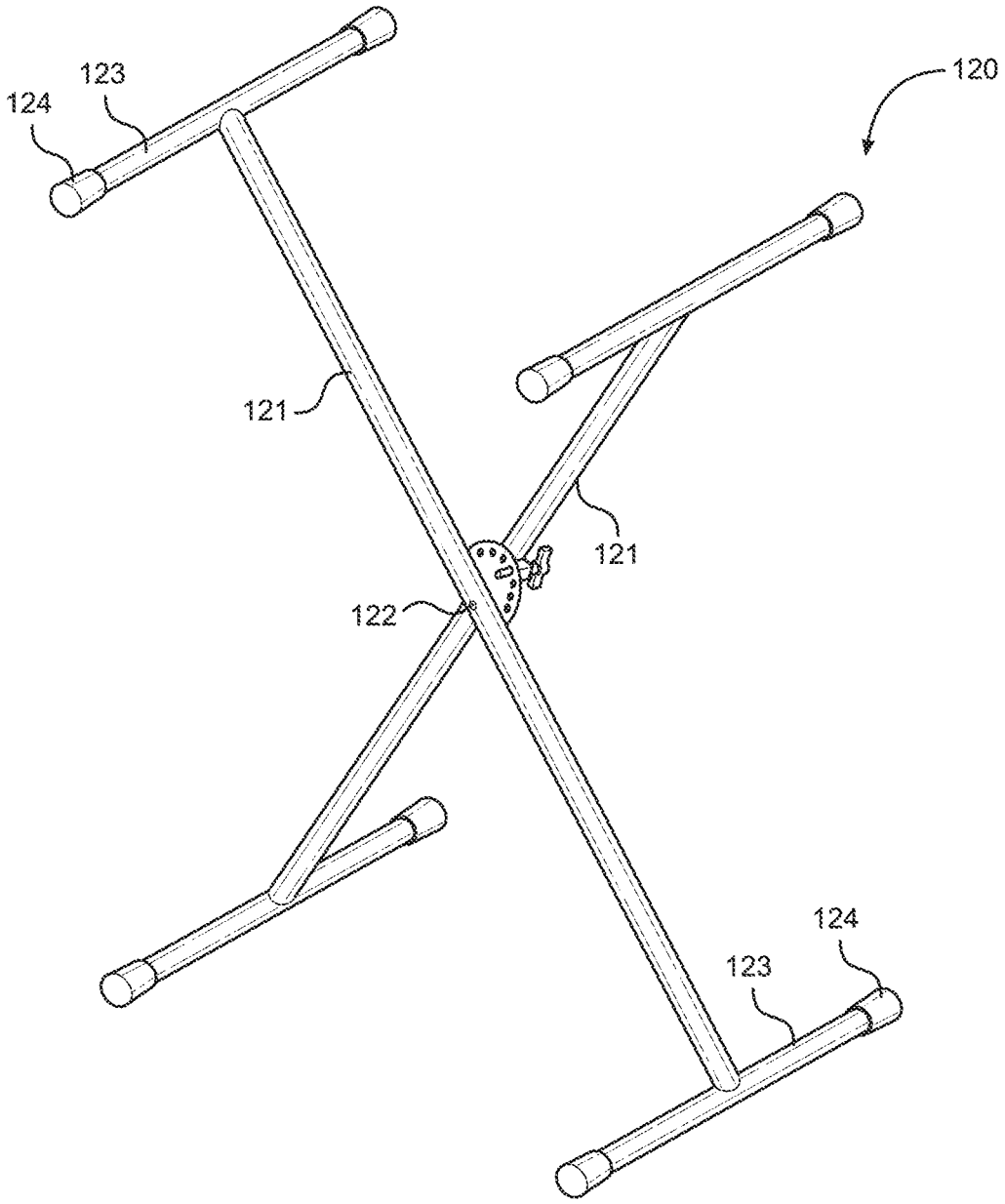
FIG. 4A illustrates in side elevation view an example modular collapsible table leg according to one embodiment of the present disclosure.

Turning next to FIG. 4A, an example modular collapsible table leg is illustrated in side elevation view. Collapsible leg 120 can be an X-shaped keyboard stand type of leg that can include elongated leg members 121 arranged in an X-shaped configuration and rotationally coupled about their midpoints by a rotational coupling 122, cross members 123 located at and extending laterally away from the distal ends of each elongated leg member 121, and tabletop support points 124 located at the distal ends of each cross member 123. Each of the elongated leg members 121 and cross members 123 can be formed from sturdy hollow metal tubes or other materials suitable for providing support and stability to a tabletop. Each of the tabletop support points 124 can be, for example, a rubber or polymer cap fitted atop the distal ends of the cross members 123. In one specific non-limiting example, collapsible leg 120 can be a KS7190 model Classic Single-X Keyboard Stand provided by On-Stage®. Of course, other similar types of X-shaped collapsible legs may also or alternatively be used.

Figure 4B:
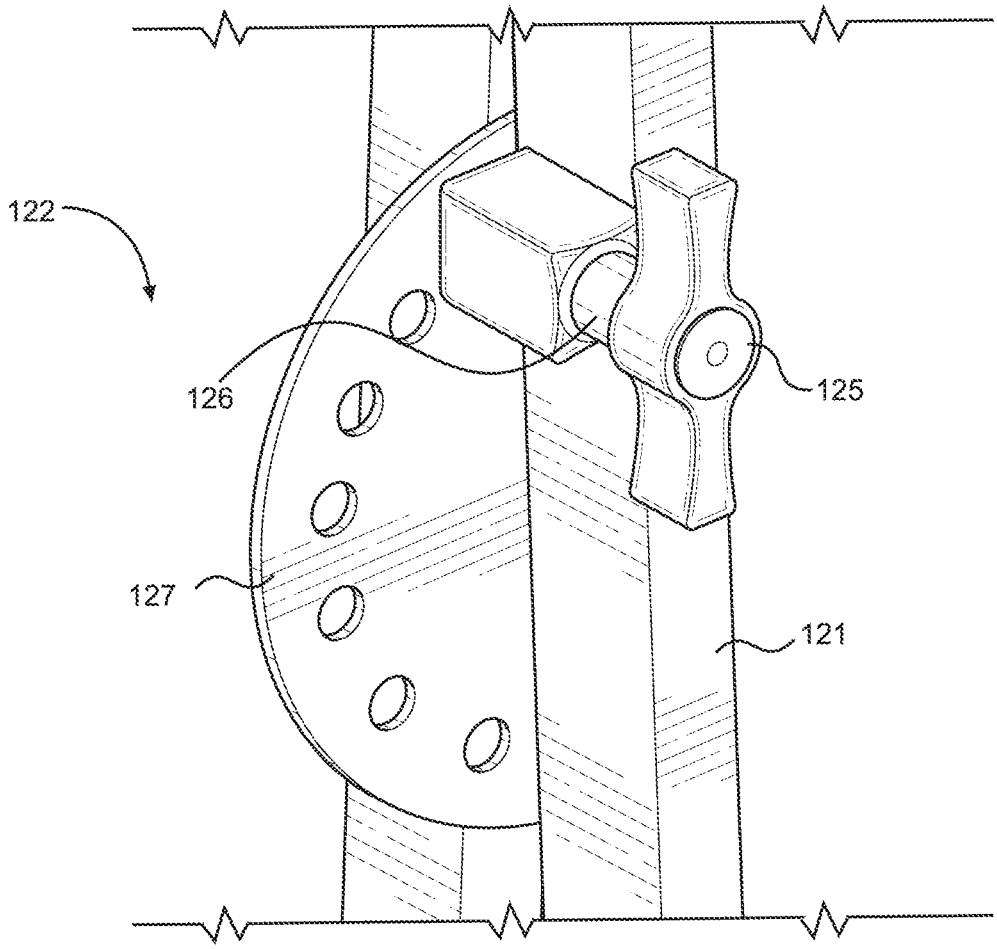
FIG. 4B illustrates in side elevation view a rotational coupling of the example modular collapsible table leg of FIG. 4A according to one embodiment of the present disclosure.

FIG. 4B illustrates in side elevation view a rotational coupling of the example modular collapsible table leg of FIG. 4A. Rotational coupling 122 can include a pull knob 125 attached to a spring-loaded pin 126 that is coupled to one elongated leg member 121 and a circular clutch plate 127 having multiple holes coupled to the other elongated leg member 121. The elongated leg members 121 can rotate with respect to each other such that the overall height of the collapsible leg 120 decreases as the angle between the elongated leg members 121 increases. Each of the multiple holes on circular clutch plate 127 can accept the spring-loaded pin 126 therein to lock the collapsible leg at a set height that is different than all of the other set heights.

Figure 5A:
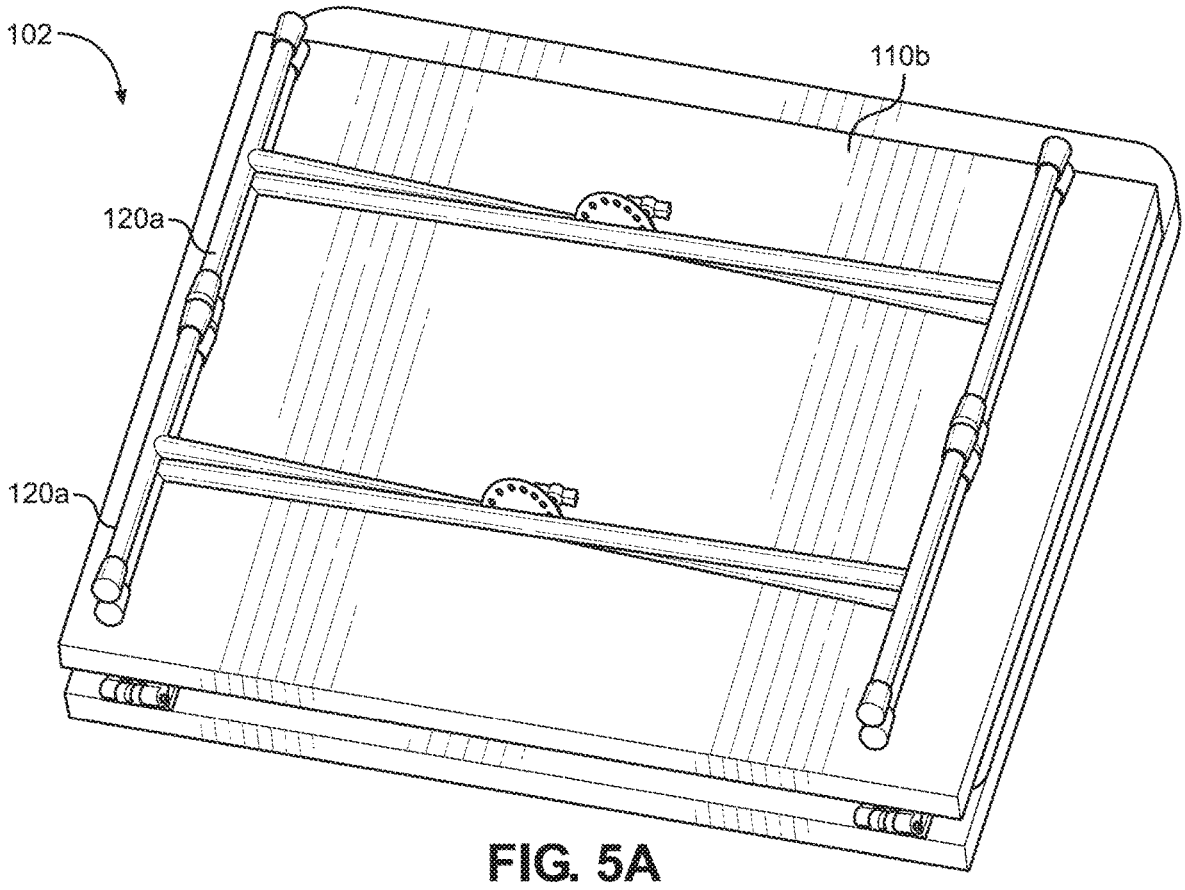
FIG. 5A illustrates in top plan view an example arrangement of a fully compacted folding tabletop and modular collapsed table legs according to one embodiment of the present disclosure.

As in the case of the tabletop 110, each of the collapsible legs 120 can be adjusted from an extended configuration to a fully compacted configuration. FIG. 5A illustrates in top plan view an example arrangement of a fully compacted folding tabletop and modular collapsed table legs. As shown, both of the collapsible legs have been collapsed from a X-formation having some distance between the cross members to a fully compacted configuration 120*a* having no distance between the cross members. Fully compacted collapsible legs 120*a* and fully compacted tabletop 110*b* can be placed adjacent to or atop each other as shown for ready transport and storage. In various embodiments, the arrangement of FIG. 5A can have overall dimensions of about 24 inches by 34 inches by 18 inches.

Figure 5B:
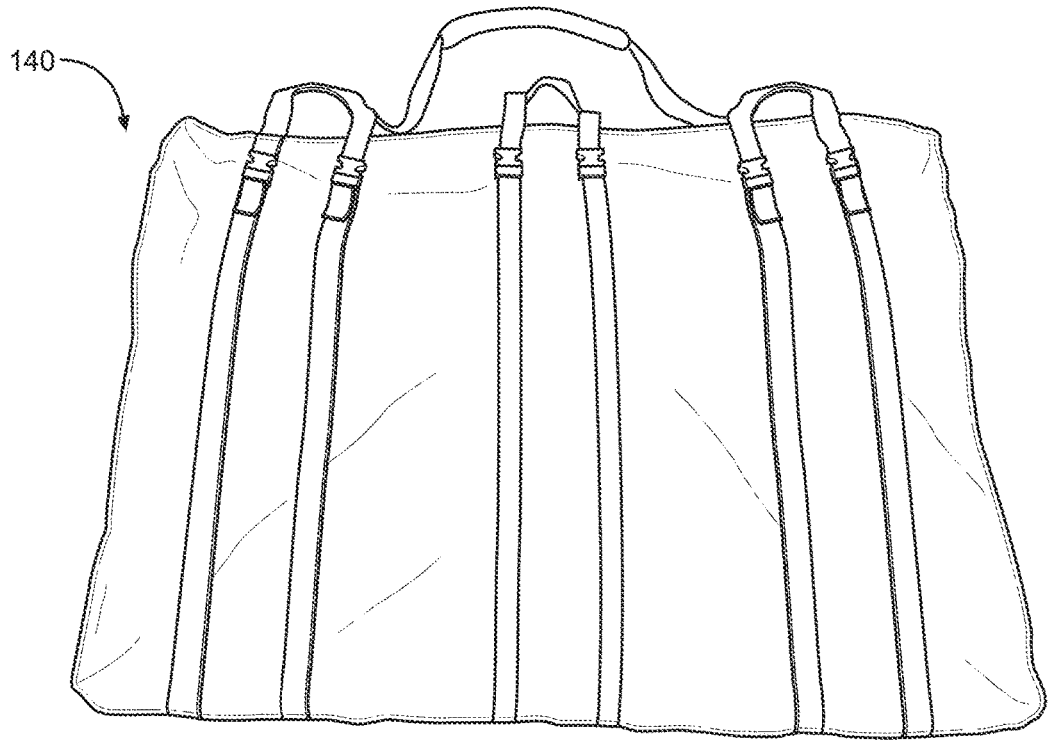
FIG. 5B illustrates in front perspective view an example storage device configured to contain the example arrangement of FIG. 5A according to one embodiment of the present disclosure.

FIG. 5B illustrates in front perspective view an example storage device configured to contain the example arrangement of FIG. 5A. Storage device 140 can be, for example, a cloth bag or backpack of a sufficiently sturdy material that is dimensioned to contain a fully compacted tabletop and collapsible legs of a portable folding table. In various embodiments, storage device 140 can be a bag having handles, loops, shoulder straps, or other components that facilitate carrying or transporting the bag. In one specific embodiment, a bag, backpack or other storage device 140 can have a length, width, and thickness of about 24 inches by 34 inches by 18 inches, such as to be able to contain the arrangement of FIG. 5A. In some embodiments, the bag or backpack can have a width of about 2 feet, such as for 2-foot-wide portable folding tables. In some embodiments, the bag or backpack can have a width of about 4 feet, such as for 4-foot-wide portable folding tables, so that the overall bag or backpack dimensions are about 48 inches by 34 inches by 18 inches. Larger bags or backpacks can be dimensioned for larger portable folding tables, and such larger bags can have additional handles or loops to allow multiple people to carry the bag and compacted table therein.

Figure 6A:
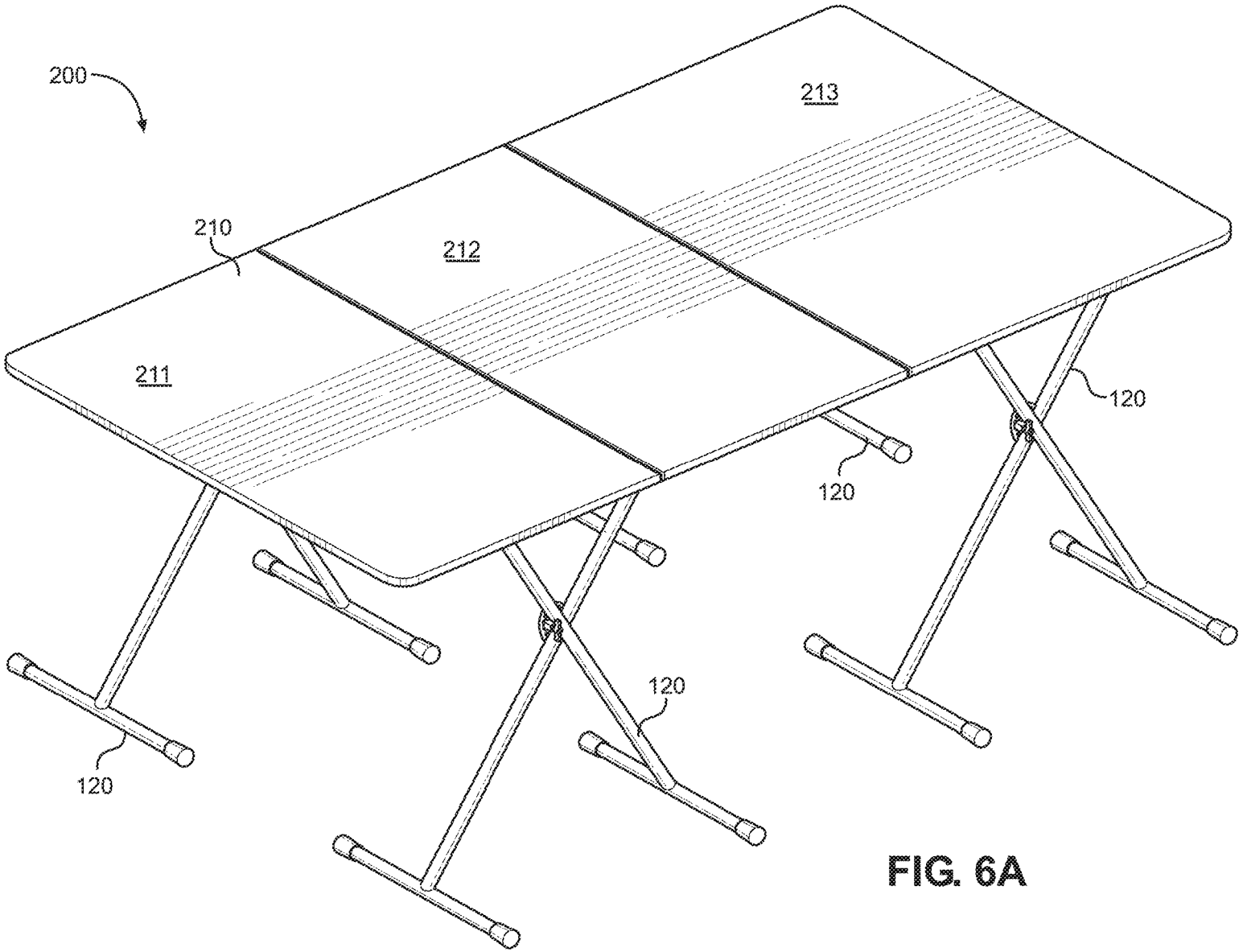
FIG. 6A illustrates in top perspective view an example alternative modular folding table with collapsible legs according to one embodiment of the present disclosure.

While the foregoing specific embodiment discloses a portable modular table having a width of about 2 feet, it will be appreciated that other width dimensions are also possible. FIG. 6A illustrates in top perspective view an example alternative modular folding table with collapsible legs. Portable modular folding table 200 can similarly include at least a tabletop 210 and multiple collapsible legs 120. Tabletop 210 can have a length of about 8 feet, a width of about 4 feet (rather than 2 feet), a thickness of about 0.5 inches, and can include three or more coupled sections, such as first section 211, second section 212, and third section 213. When tabletop 210 is in a fully extended configuration as shown, first section 211, second section 212, and third section 213 can be positioned flush against each other and can combine to form a substantially continuous and unbroken flat upper surface. As shown, folding table 200 can be supported by four collapsible legs 120 rather than two legs.

Figure 6B:
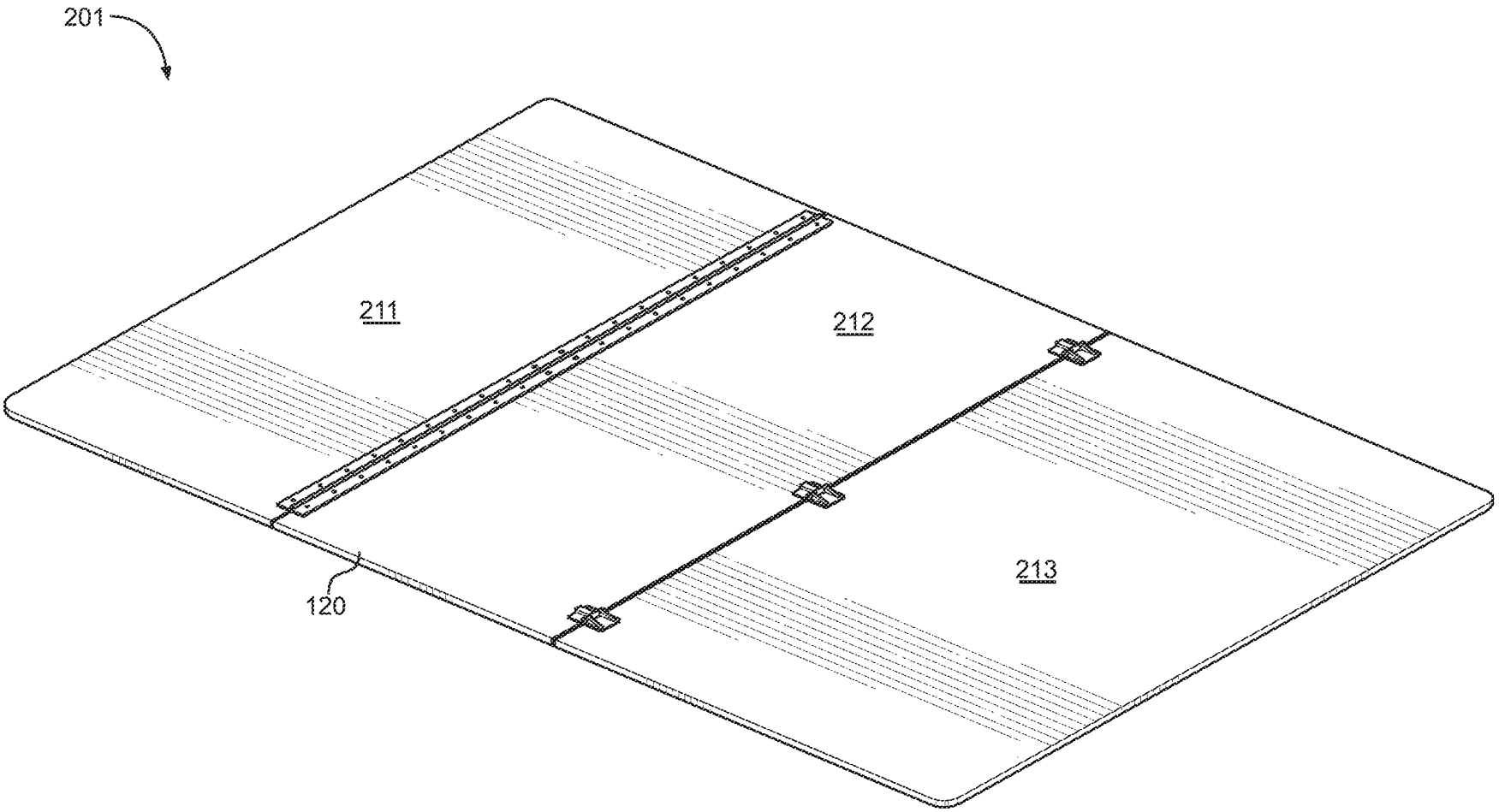
FIG. 6B illustrates in bottom perspective view the example alternative modular folding table of FIG. 6A with its tabletop removed from its collapsible legs according to one embodiment of the present disclosure.

FIG. 6B illustrates in bottom perspective view the example alternative modular folding table of FIG. 6A with its tabletop removed from its collapsible legs in configuration 201. Tabletop 210 and its tabletop sections 211, 212, 213 can be substantially similar to tabletop 110 and sections 111, 112, 113 above. For example, a continuous piano type hinge 230 can extend almost the full width across tabletop sections 211 and 212 to pivotally couple these sections together. To provide added stability and support for the double wide nature of 4×8 foot tabletop 210, an additional butt type hinge 231 can be used to couple tabletop section 213 to tabletop section 212, with a total of three butt type hinges 231 being used.

Alternative embodiments for the modular and portable folding tables disclosed herein may include variations on the size and shapes of the tabletop, as well as on the types and details of the modular collapsible legs. The modular collapsible legs may alternatively be, for example, tent pole style legs.

Figure 7A:
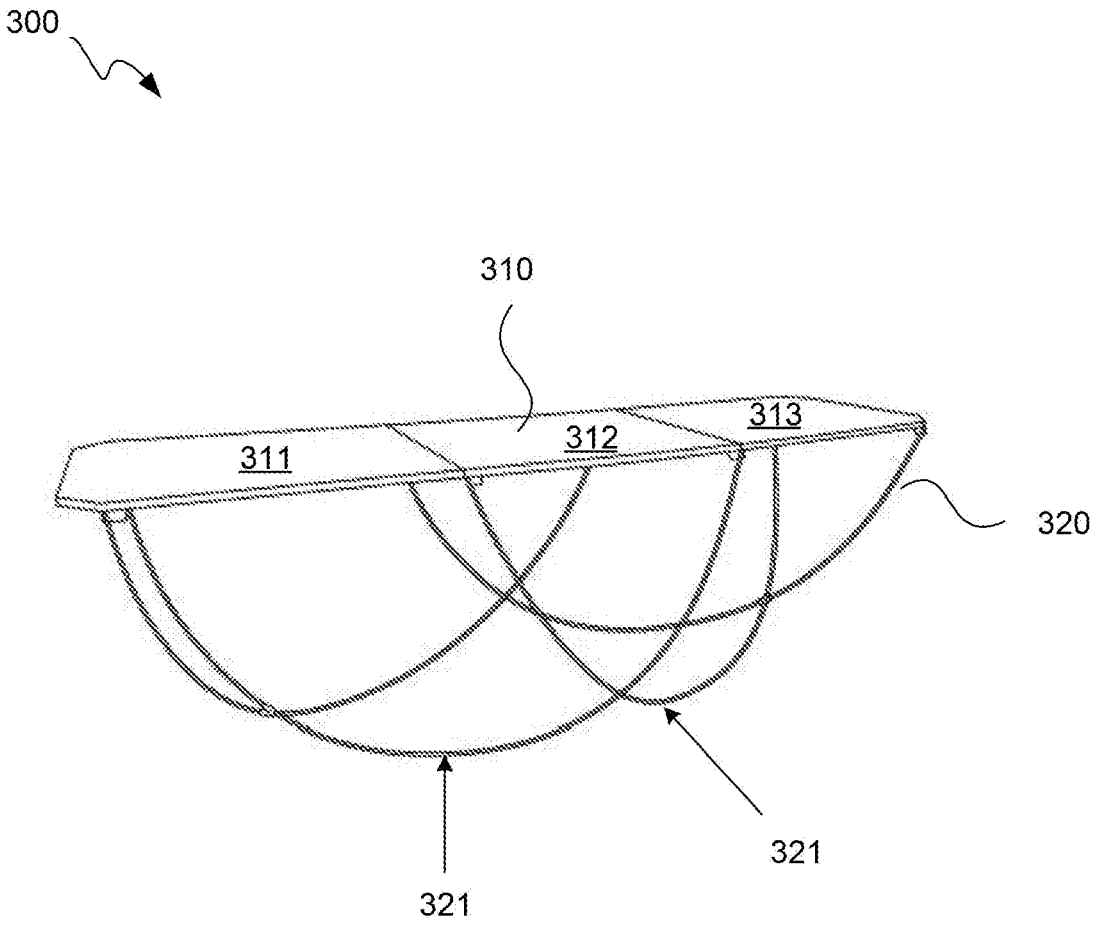
FIG. 7A illustrates in side perspective view an example alternative modular folding table with collapsible tent pole style legs according to one embodiment of the present disclosure.

Transitioning to FIG. 7A, an example alternative modular folding table with collapsible tent pole style legs is illustrated in side perspective view. Folding table 300 is shown as being set-up and in ready position. Table 300 can have a tabletop 310 with three sections 311, 312, 313 that are coupled by hinges that allow the table to fold and store in a much more compact form. Folding table 300 can include four tent pole style collapsible legs 320 which are held on by pressure. As shown, collapsible legs 320 can be bent in order to provide force that holds each leg in place, like how tent poles bend when setting up a tent. Collapsible legs 320 can make four points of contact 321 with the floor, ground, or other lower surface, thus making the table 300 sturdy when fully assembled. While the collapsible legs of table 300 are tent pole style legs, it will be readily appreciated that different types and styles of legs or supports may be used, and that these are not limited to tent pole style legs.

Figure 7B:
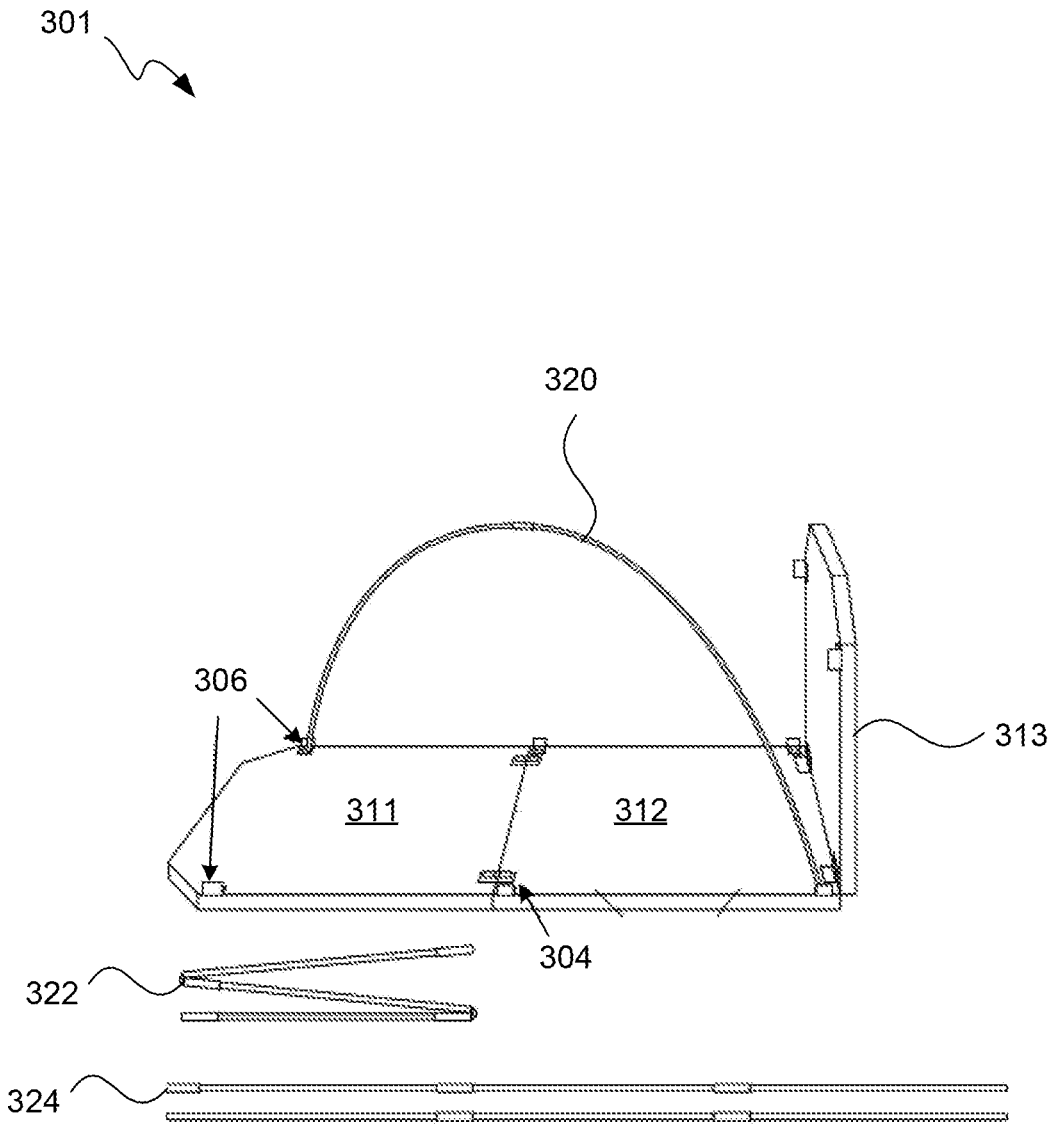
FIG. 7B illustrates in side perspective view the example alternative modular folding table of FIG. 7A in a partially compacted configuration according to one embodiment of the present disclosure.

FIG. 7B illustrates in side perspective view the example alternative modular folding table of FIG. 7A in a partially compacted configuration 301. Similar to the foregoing embodiments, tabletop 310 can include three sections 311, 312, 313 coupled together by hinges in a manner that they can be folded inward onto each other. In some embodiments, one or more locks 304 can lock the tabletop sections 311, 312, 313 in place when the tabletop is extended and unlock when the table needs to be put away. Various corners at the bottoms of tabletop sections 311, 312, 313 can feature a small loop component 306 that can hold a distal end of a tent rod type collapsible leg 320. The tent rod type collapsible legs 320 can be bent into two opposing loops components 306 and held in place by the pressure that the leg exerts from the bend. The tent rod type collapsible legs 320 can work like standard tend rods in the way that they can be taken apart and collapsed into a compacted formation 322 and extended into an expanded formation 324 when ready for use.

Figure 7C:
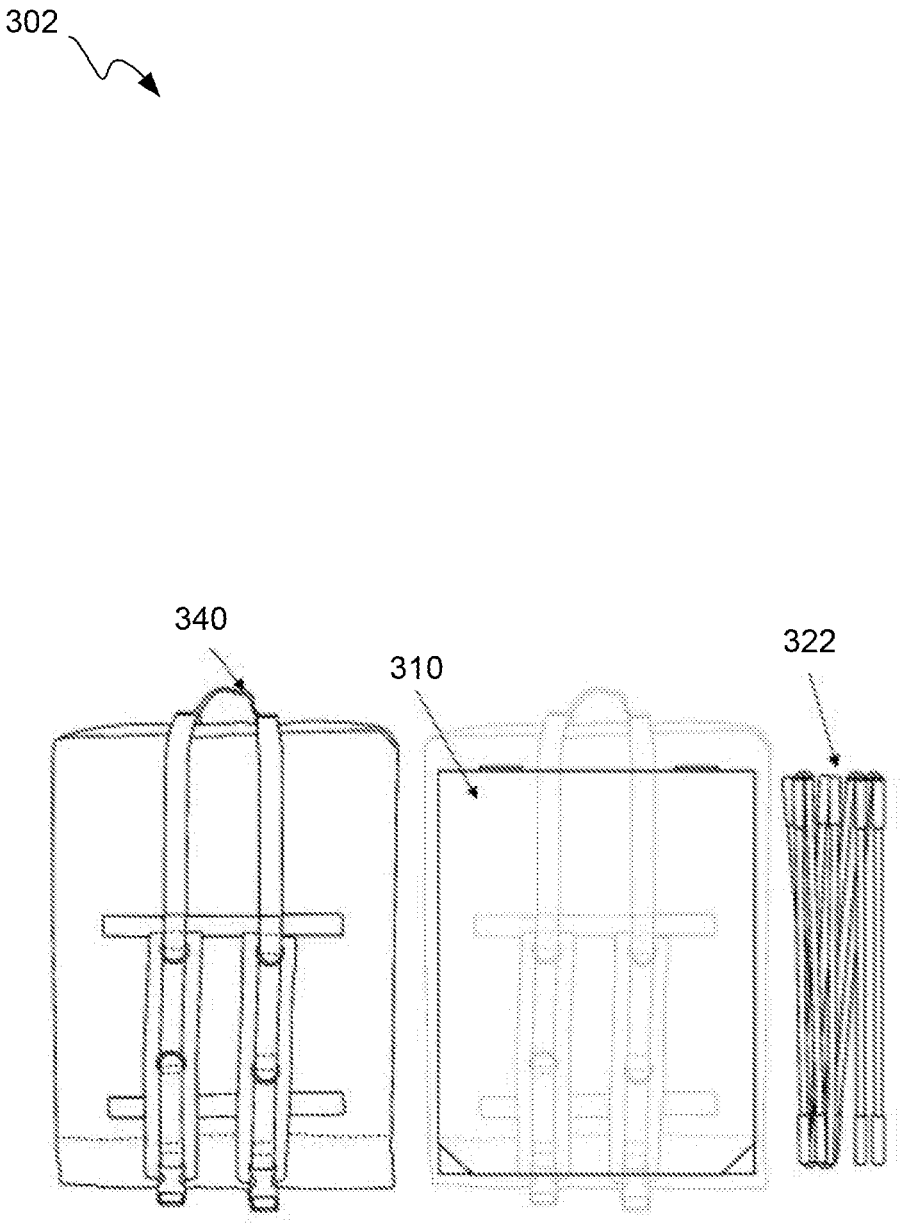
FIG. 7C illustrates in side elevation view the example alternative modular folding table of FIG. 7A in a fully compacted configuration and an example storage device according to one embodiment of the present disclosure.

Finally, FIG. 7C illustrates in side elevation view the example alternative modular folding table of FIG. 7A in a fully compacted configuration 302 and an example storage device 340 configured to contain the folding table. As shown, the tabletop 310 and collapsible legs 322 have been compacted enough to fit into a bag, backpack, or other storage device 340 that can be carried or worn by a user.

Although the foregoing disclosure has been described in detail by way of illustration and example for purposes of clarity and understanding, it will be recognized that the above described disclosure may be embodied in numerous other specific variations and embodiments without departing from the spirit or essential characteristics of the disclosure. Certain changes and modifications may be practiced, and it is understood that the disclosure is not to be limited by the foregoing details, but rather is to be defined by the scope of the appended claims.

What is claimed is:

1. A portable modular folding table, comprising:

a substantially flat tabletop having a width, and a length that is at least twice as large as the width, wherein the tabletop includes three or more tabletop sections having the same width that are coupled to and foldable onto each other;

a plurality of hinges coupled to the three or more tabletop sections, the plurality of hinges facilitating the folding and unfolding of the three or more tabletop sections onto each other;

a plurality of collapsible legs that are modular and separate from the tabletop, each of the plurality of collapsible legs being adjustable to multiple different heights; and wherein in a folded configuration a first tabletop section is folded onto a second tabletop section, and a second tabletop section is folded onto a third tabletop section, and each of the first, second and third table top sections when in the folded configuration are substantially parallel to one another, and wherein a bottom surface of the first tabletop section connects with a bottom surface of the second tabletop section, and a top surface of the second tabletop section connects with a top surface of the third tabletop section.

2. The portable modular folding table of claim 1, wherein the three or more tabletop sections are foldable onto each other to reduce the length of the tabletop by less than half when the tabletop is reduced from a fully extended configuration to a fully compacted configuration.

3. The portable modular folding table of claim 2, wherein a first tabletop section has a first length, a second tabletop section has a second length that is greater than the first length, and a third tabletop section has a third length that is greater than the second length.

4. The portable modular folding table of claim 1, wherein each of the plurality of collapsible legs includes at least four tabletop support points, and wherein the tabletop rests atop at least some of the tabletop support points when the tabletop is in a fully extended configuration and the tabletop is separate from and stored alongside the plurality of collapsible legs when the tabletop is in a fully compacted configuration.

5. The portable modular folding table of claim 1, wherein a first hinge of the plurality of hinges couples a first tabletop section to a second tabletop section of the three or more tabletop sections along the first and second tabletop section widths, and wherein the first hinge pivots the first tabletop section from a first position alongside and abutting the second tabletop section to a second position directly atop and contacting the second tabletop section.

6. The portable modular folding table of claim 5, wherein the first hinge extends along at least 80 percent of the first and second tabletop section widths.

7. The portable modular folding table of claim 5, wherein a second hinge of the plurality of hinges couples a third tabletop section to the second tabletop section along the third and second tabletop section widths, and wherein the second hinge pivots the third tabletop section from a third position alongside and abutting the second tabletop section to a fourth position directly atop and contacting the first tabletop section when the first tabletop section is in the second position.

8. The portable modular folding table of claim 7, wherein the second hinge pivots the third tabletop section such that there is a gap between the second tabletop section and third tabletop section when the third tabletop section is substantially parallel with the second tabletop section, and wherein the thickness of the gap is substantially the same as the thickness of the first tabletop section.

9. The portable modular folding table of claim 1, wherein each of the plurality of collapsible legs includes a rotational coupling, two elongated leg members arranged in an X configuration and rotationally coupled at about the center points of their respective lengths by the rotational coupling, and a cross-member at each distal end of each elongated leg member, each cross-member extending away laterally from its respective elongated leg member.

10. The portable modular folding table of claim 9, wherein each of the plurality of collapsible legs is adjustable to multiple different heights by adjusting the rotational coupling.

11. The portable modular folding table of claim 9, wherein the tabletop support points are located at the distal ends of the cross-members.

12. The portable modular folding table of claim 11, wherein at least one of the collapsible legs is configured to provide the tabletop support points of one cross-member proximate one of the plurality of hinges when the tabletop rests atop the tabletop support points.

13. The portable modular folding table of claim 12, wherein the at least one of the collapsible legs is further configured to provide the tabletop support points at another cross-member at an end section of the tabletop when the tabletop rests atop the tabletop support points.

14. The portable modular folding table of claim 9, wherein each of the plurality of collapsible legs is a bendable tent-pole style of leg.

15. The portable modular folding table of claim 14, wherein the width of the each of the three or more tabletop sections is about two feet.

16. The portable modular folding table of claim 14, wherein the width of the each of the three or more tabletop sections is about four feet.

17. The portable modular folding table of claim 1, wherein the length of the tabletop is about eight feet when the tabletop is in a fully extended configuration.

18. The portable modular folding table of claim 17, wherein the tabletop and plurality of collapsible legs are all configured to be stored within the same storage device when the tabletop is in a fully compacted configuration and all of the plurality of collapsible legs are collapsed, the storage device having a length, width, and thickness of about 24 inches by 34 inches by 18 inches.

19. A folding table, comprising:

a substantially flat tabletop having a width and a length that is at least twice as large as the width, wherein the tabletop includes three or more tabletop sections that are coupled to and foldable onto each other;

a plurality of hinges coupled to the three or more tabletop sections, the plurality of hinges facilitating the folding and unfolding of the three or more tabletop sections onto each other;

a plurality of collapsible legs that are adjustable to multiple different heights, wherein the tabletop rests atop the plurality of collapsible legs when the tabletop is in a fully extended configuration; and wherein in a folded configuration a first tabletop section is folded onto a second tabletop section, and a second tabletop section is folded onto a third tabletop section, and each of the first, second and third table top sections when in the folded configuration are substantially parallel to one another, and wherein a bottom surface of the first tabletop section connects with a bottom surface of the second tabletop section, and a top surface of the second tabletop section connects with a top surface of the third tabletop section.

20. A portable modular folding table, comprising:

a substantially flat tabletop having a thickness, a width, and a length that is at least twice as large as the width, wherein the tabletop includes exactly three tabletop sections of the same width that are coupled to and foldable onto each other to reduce the length of the tabletop by less than half when the tabletop is reduced from a fully extended configuration to a fully compacted configuration, and wherein a first tabletop section has a first length, a second tabletop section has a second length that is greater than the first length, and a third tabletop section has a third length that is greater than the second length;

a first hinge that couples the first tabletop section to the second tabletop section along the first and second tabletop section widths, wherein the first hinge pivots the first tabletop section from a first position alongside and abutting the second tabletop section to a second position directly atop and contacting the second tabletop section, and wherein the first hinge extends along at least 80 percent of the first and second tabletop section widths;

a second hinge that couples the third tabletop section to the second tabletop section along the third and second tabletop section widths, wherein the second hinge pivots the third tabletop section from a third position alongside and abutting the second tabletop section to a fourth position directly atop and contacting the first tabletop section when the first tabletop section is in the second position, and wherein the second hinge pivots the third tabletop section such that there is a gap between the second tabletop section and third tabletop section when the third tabletop section is substantially parallel with the second tabletop section, the gap having a thickness that is substantially the same as the thickness of the first tabletop section;

wherein in a folded configuration the first tabletop section is folded onto the second tabletop section, and the second tabletop section is folded onto the third tabletop section, and each of the first, second and third table top sections when in the folded configuration are substantially parallel to one another, and wherein a bottom surface of the first tabletop section connects with a bottom surface of the second tabletop section, and a top surface of the second tabletop section connects with a top surface of the third tabletop section; and a plurality of collapsible legs that are modular and separate from the tabletop, each of the plurality of collapsible legs being adjustable to multiple different heights and having at least four tabletop support points, wherein the tabletop rests atop the tabletop support points of the plurality of collapsible legs when the tabletop is in a fully extended configuration and the tabletop is separate from and stored alongside the plurality of collapsible legs when the tabletop is in a fully compacted configuration.

* * * * *